US005311846A

United States Patent [19]

Mueller

[11] Patent Number: 5,311,846

[45] Date of Patent: May 17, 1994

[54] HYDRAULIC CONTROL DEVICE

[75] Inventor: Martin Mueller, Moeglingen, Fed. Rep. of Germany

[73] Assignee: Robert Bosch GmbH, Stuttgart, Fed. Rep. of Germany

[21] Appl. No.: 64,011

[22] PCT Filed: Sep. 4, 1992

[86] PCT No.: PCT/DE92/00741

§ 371 Date: May 14, 1993

§ 102(e) Date: May 14, 1993

[87] PCT Pub. No.: WO93/08378

PCT Pub. Date: Apr. 29, 1993

[30] Foreign Application Priority Data

Oct. 26, 1991 [DE] Fed. Rep. of Germany ..... 4135378

[51] Int. Cl.[5] ..... F01L 1/34

[52] U.S. Cl. ..... 123/90.17; 123/90.31; 464/2; 74/568 R

[58] Field of Search ..... 123/90.15, 90.17, 90.31; 464/1, 2, 160; 74/567, 568 R

[56] References Cited

U.S. PATENT DOCUMENTS 5,167,206 12/1992 Suga ..... 123/90.17
5,178,106 1/1993 Suga ..... 123/90.17
5,189,999 3/1993 Thoma ..... 123/90.17

FOREIGN PATENT DOCUMENTS 3247916 6/1984 Fed. Rep. of Germany .
3929621 3/1991 Fed. Rep. of Germany .
3929623 3/1991 Fed. Rep. of Germany ... 123/90.17
2657648 8/1991 France .
855582 12/1960 United Kingdom .

*Primary Examiner*—Raymond A. Nelli
*Assistant Examiner*—Weilun Lo
*Attorney, Agent, or Firm*—Michael J. Striker

[57] ABSTRACT

A hydraulic control device for rotating a cam shaft of an internal combustion engine has a sprocket wheel driven by an internal combustion engine, a couple member engageable with a cam shaft and supported by one end of the sprocket wheel and engaging in a central bore hole of the sprocket wheel, a magnet valve arranged so that the couple member is axially displaceable by a liquid pressure controlled by the magnet valve to bring about a relative rotation of the cam shaft relative to the sprocket wheel, and a main piston acting on the couple member and arranged so that the liquid pressure acts on the main piston. A hydraulic body is mounted on the drive wheel, and an axial piston pump is arranged in the hydraulic body and has axial bore holes and a plurality of additional pistons which slide in the bore holes and having outer rounded portions which contact a wobble plate. Outlet valves are arranged at an outlet side of the bore holes and connected to a pressure space defined by the main piston. The main piston and the couple member are arranged so that an element providing a mechanical force acting against a force of the main piston acts on the couple member.

11 Claims, 2 Drawing Sheets

HYDRAULIC CONTROL DEVICE

BACKGROUND OF THE INVENTION

The present invention relates to a hydraulic control device for rotating a cam shaft of an internal combustion engine.

More particularly it relates to a hydraulic control device which has a couple member which is longitudinally displaceable by pressure force and has a first toothing engaging a toothing at an inner circumference of a cam shaft and supported in a sprocket wheel driven by the internal combustion engine and a second toothing engaging with an inner toothing of a sprocket wheel bore, wherein the couple member is actually displaceable by a liquid pressure controlled by a magnet valve.

Hydraulic control devices of the above-mentioned general type are known in the art. One such hydraulic control device is disclosed in the German patent document DE-OS 32 47 916. In such a known control device in particular the pump and the magnet valve are arranged externally, which is relatively complicated particularly in view of the necessary pressure medium connections and also entails a considerable cost in construction.

SUMMARY OF THE INVENTION

Accordingly, it is an object of the present invention to provide a hydraulic control device of the above-mentioned type, which avoids the disadvantages of the prior art.

In keeping with these objects and with others which will become apparent hereinafter, one feature of the present invention resides, briefly stated, in a hydraulic control device for rotating a cam shaft of an internal combustion engine, in which the liquid pressure acts on a piston acting on the couple member, in that a hydraulic body is flanged on at the drive wheel to which the cam shaft is also connected, an axial piston pump being arranged in the hydraulic member and receiving a plurality of pistons which slide in axial bore holes and have outer rounded portions contacting a wobble plate, outer valves are arranged at the outlet side of the bore holes and connected to a pressure space defined by the piston and controlled by a magnet valve, and a mechanical force acting against the force of the piston acts on the couple member.

When the hydraulic control device is designed in accordance with the present invention, it has the advantage over the prior art of a very compact construction and a very simple installation in an internal combustion engine or its engine compartment.

In accordance with another feature of the present invention, the bore holes receiving the pistons slide in pump bodies which are formed in axially extending bore holes of the hydraulic body and extend concentrically to each longitudinal axis. The pump bodies can have web-like prolongations by which they dip into recesses of the wobble plate.

An intermediate part can be connected between the cam shaft and the sprocket wheel and have a continuation which dips into a longitudinal bore hole of the cam shaft, while the spur toothing can be formed at an inner periphery. The cam shaft can be provided with a widened, flange-like end adjoined by the intermediate part and, coaxially thereto the sprocket wheel and the hydraulic body, and these parts can be connected by screws.

In accordance with still another feature of the present invention, the electromagnetic valve can be arranged coaxially relative to the hydraulic body and located partially within the same. The hydraulic body can include two parts, namely a first body directly adjoining the sprocket wheel and connected to at least one pump body held by a screw penetrating the widened end part of the cam shaft.

The mechanical force can be generated by a spring, or by a spiral toothing on the couple member whose pitch angle can be approximately 30°–45°.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
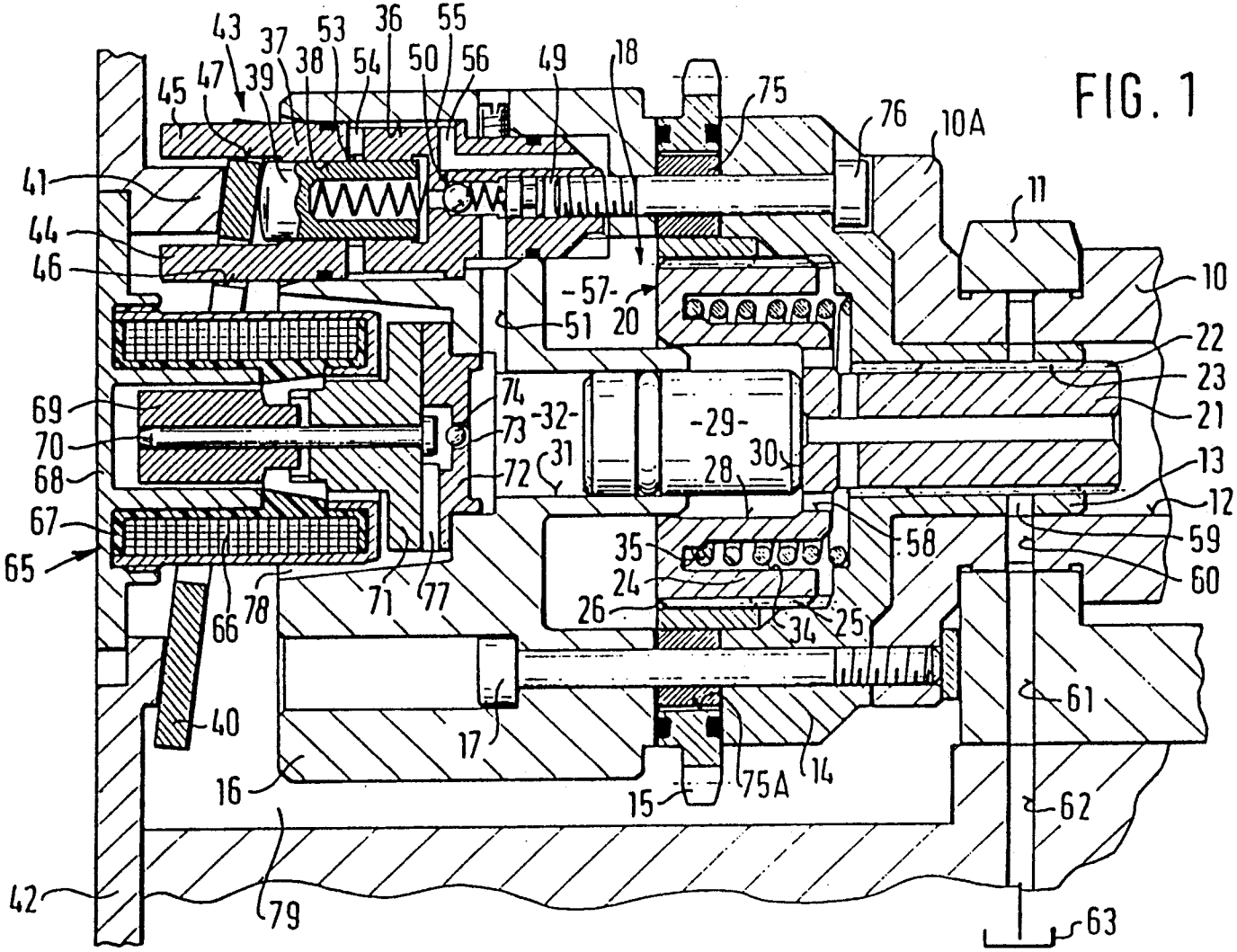
FIG. 1 shows a longitudinal section of a first embodiment example of a hydraulic control device for rotating the camshaft of an internal combustion engine.

In the drawing, the camshaft of an internal engine combustion engine is designated by 10 and is supported in the camshaft bearing block 11 of the internal combustion engine. The camshaft has a continuous longitudinal bore 12. The sleeve-shaped continuation 13 of a flange part 14 which is constructed roughly in the shape of a bowl projects into this longitudinal bore 12. A sprocket wheel 15 for driving the camshaft 12 is connected to the front face of the flange part, followed by a cylindrical hydraulic body (main housing) 16. The parts 12 to 16 are held together so as to be fixed with respect to relative rotation by screws 17. The above-mentioned parts form an internal hollow space 18 in which a couple member or coupling member 20 is arranged. This couple member 20 has a shaft 21 which projects into the continuation 13 of the flange part 14. A radial or spur toothing or gear teeth 22 is constructed at the outer circumference of the shaft 21 and engages with an identical spur toothing or gear teeth 23 at the inner circumference of the sleeve-shaped continuation. This is followed by a bowl-shaped ring part 24 as integral part on the shaft 21 of the couple member 20. The ring part 24 has an inclined or spiral toothing or gear teeth 25 at its outer circumference which engages with an identical spiral toothing or gear teeth 26 at the inner circumference of the sprocket wheel 15. A piston 29 having constant contact with the base 30 of the couple member dips into the hollow 28 of the couple member or its ring part 24. The piston 29 is supported in a central, continuous bore hole 31 of the hydraulic body 16 and defines a pressure space 32 therein. A deep, axially extending annular groove 34 is formed in the ring part 24 of the couple member 20. A pressure spring 35 which is supported at the base of the flange part 14 and constantly brings the couple member 20 into contact With the piston 29 is arranged in the annular groove 34.

A plurality of axially extending bore holes 36 are constructed in the hydraulic body 16 in an eccentric, but concentric manner. Pump bodies (pump housings) 37 which receive pistons 39 in their bore holes 38 are arranged in these axially extending bore holes 36. The rounded portions of these pistons 39 are supported on an inclined wobble plate 40 which contacts a diagonally extending, annular crosspiece surface 41 of a stationary plate 42. It is evident from this that it is an axial piston pump 43. Every pump body 37 has two web-like continuations 44, 45 which project into corresponding recesses 46, 47 of the wobble plate 40. Thus when the hydraulic body 16 rotates when driven by the sprocket wheel 15, the wobble plate 40 also executes a gyrating or wobbling rotational movement. Lubricating grooves, not shown in more detail, are advisably constructed at the crosspiece surface 41.

A bore hole 49 of small diameter adjoins the bore hole 38 receiving the piston 39, an outlet valve 50 being arranged in this bore hole 49. The construction of this outlet valve 50 is conventional and therefore not discussed in more detail. A duct 51 leads from a location behind the outlet valve into a pressure space 32.

An annular groove 53 opens out at the piston bore hole 38. A transverse hole 54 which is arranged in the pump body 37 opens into this annular groove 53 and again into a longitudinal groove 55 lying at the outer circumference of the pump body and adjoining the hydraulic body 16. The longitudinal groove 55 in turn opens into an angled duct 56 which communicates with an annular space 57 in the hydraulic body 16. The spiral toothing 25, 26 and an adjoining duct 58 form the connection from the annular space 57 to the spur toothing 22, 23 at the couple member 20. An annular groove 59 is constructed at the inner circumference of the continuation 13 of the flange part 14. A transverse bore 60 which is arranged in the camshaft 10 and is in turn connected with a transverse bore hole 61 in the camshaft bearing block 11 opens into the annular groove 59. The transverse bore hole 61 is connected with an oil receptacle 63 via a bore hole 62 constructed in the cylinder head.

A magnet valve 65 which operates in a flow-proportional manner and accordingly forms a proportional pressure control valve adjoins the pressure space 32. This magnet valve 65 has a coil 66 which is arranged in a coil body 67 and simultaneously forms a cover 68. The armature 69 in which a tappet 70 is securely arranged is located inside the coil body 67. This tappet 70 slides in a pole plate 71 which is turn contacts a plate 72 closing the bore hole 31. A continuous bore hole 73 is constructed in this plate 72 and is controlled by the spherical valve body 74 of the electromagnetic valve 65 and is actuated by the tappet 70. A transversely extending duct 77—thus arranged at the output of the electromagnetic valve—is located between the plate 72 and pole plate 61 and opens into the recess 78 in the hydraulic body 16. There is also a connection from the space 79 situated in the latter to the receptacle 63. Additional bore holes and ducts, not shown, e.g. in the shaft 21 of the couple member, have no bearing on the present invention.

It should also be noted that the pump bodies 37 are secured by screws 76 which penetrate the flange part 14, the sprocket wheel 15 and the hydraulic body 16. Bushes 75 which lie in corresponding curved slots 75A of the sprocket wheel are arranged at the locations where the screws 17, 76 traverse the sprocket wheel and are penetrated by these screws so that the camshaft 10 can be rotated relative to the sprocket wheel 15.

The hydraulic control device operates in the following manner: when the camshaft 10 is set in rotation by the sprocket wheel 15, the flange part 14 and the hydraulic body 16 also participate in the rotation. The pistons 39 of the axial piston pump now execute lifting movements due to their contact at the wobble plate 40. They suck pressure medium out of the receptacle 63 via the following connection: transverse bore holes 62, 61, 60, annular groove 59, spur toothing 22, 23, duct 58, spiral toothing 25, 26, annular space 57 in the hydraulic body 16, duct 56, longitudinal groove 55, transverse hole 54, and annular groove 53 at the piston bore hole 38.

When no current is applied to the magnet valve 65, the valve body 74 is lifted from its valve seat and the pressure medium which is conducted into the pressure space 32 by the pistons 39 via the outlet valve 50 is pushed out without pressure into the space 79 or the receptacle 63 via the magnet valve, the transverse bore hole 77 and the recess 78.

The pressure spring 35 slides the couple member 20 to the left (in the direction of the magnet valve 65) and the camshaft 10 is rotated relative to the sprocket wheel 15 via the described teeth. It occupies a first position. At maximum current to the magnet valve, the valve body 74 is pressed on its valve seat by the action of the armature 69 and the tappet 70. At this point, the pressure in the pressure space 32 reaches its maximum value and slides the piston 29 to the right, the latter displacing the couple member 20. The camshaft 10 is now rotated relative to the sprocket wheel 15 into a second position due to the teeth described above. At partial current to the magnet valve, the couple member, and accordingly also the camshaft, can be brought into optional intermediate positions.

Figure 2:
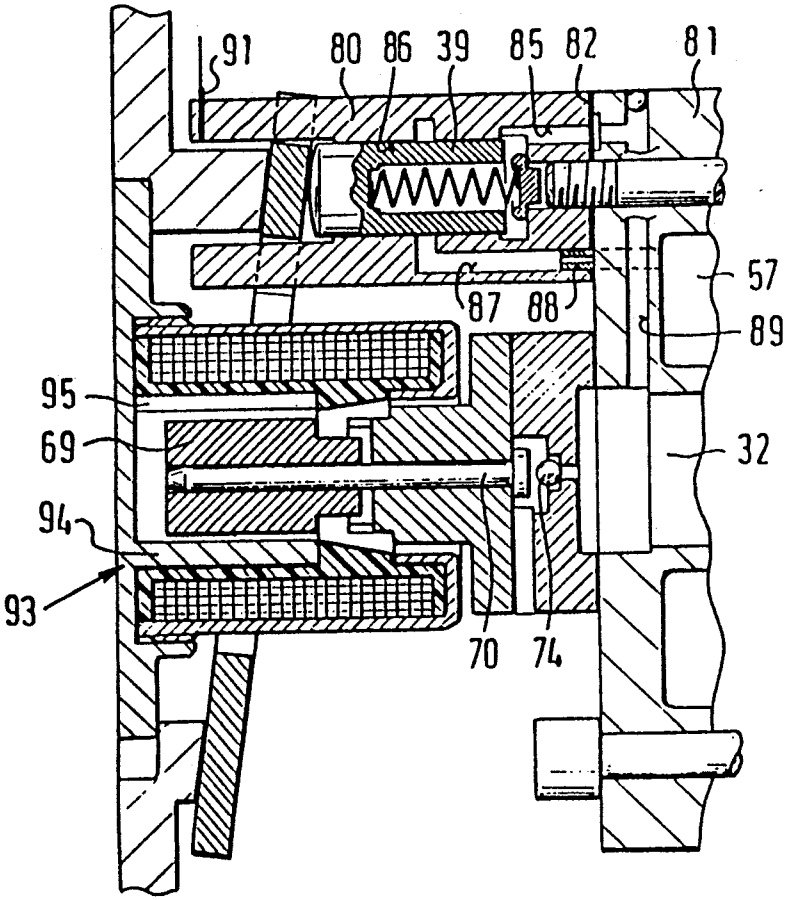
FIG. 2 shows a modification of this embodiment example.

The embodiment example according to FIG. 2 differs from the previous embodiment example substantially in that the hydraulic body is constructed somewhat differently. It now has two parts 80, 81, one of which 81 directly adjoins the camshaft and is screwed together with the latter. The part so—designated here as pump body—is likewise screwed to the camshaft. (However, in this instance the screws are arranged differently, but this is not at all essential to the invention.)

The pump body 80 is not constructed so as to be symmetrical with respect to rotation and includes a sleeve which—as described above—is screwed together With the camshaft. The pump body is discussed only briefly since its construction is extensively identical to that of the preceding embodiment example. Identical parts are provided with the same reference numbers. The difference here consists in the manner in which the pressure medium is conveyed to and away from the pump body.

Figure 3:
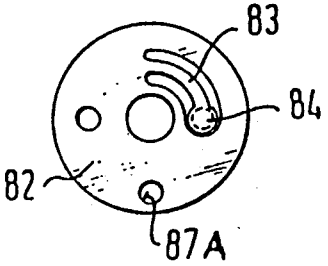
FIG. 3 shows a detail.

A spring disk 82 is arranged between the pump body 80 and the part 81 as is shown in FIG. 3 in a top view. It simultaneously forms the outlet valve in the form of a spring tongue 83 which is enlarged 84 at its end contacting the outlet bore hole 85 of the piston bore hole 86. The spring disk is held by a positioning pin which is not shown in greater detail. A bore hole 87A is also located in the spring plate. The suction bore hole 87 in which is arranged a suction throttle 88 connected with hole 87A in the spring plate 82 extends in the pump body 80. The suction bore hole 87 leads up to the space 57 which is connected with the pressure medium reservoir. The outlet bore hole 85 is connected to the pressure space 32 via a duct 89. For easy mounting of the pump body or pump bodies 80, a wire clasp 91 is provided which fixes the wobble plate with the piston pump acted upon by spring pressure in the preassembled adjusting unit. This is not discussed in greater detail.

The electromagnetic valve 93 is also slightly modified compared to the embodiment example in FIG. 1. In addition to the armature 69, a longitudinal groove 95 is constructed in the coil body 94. Accordingly, eddy currents which exert a deceleration moment on the armature are induced in the excited electromagnetic valve during the rotation of the camshaft and armature. The suspension of the armature at the tappet 70 and the transmission of force to the valve body 74 allow the rotation of the armature and magnet core. The rotating tappet exhibits virtually no frictional force during axial movement. The electromagnetic valve accordingly has low hysteresis so that the pressure in the pressure space 32 can be adjusted in a particularly exact manner.

Voltage can also be applied to the magnet valves described in the two embodiment examples at a frequency of roughly 100 Hertz and a variable duty ratio. Duty ratio is understood as the ratio of supplied current duration of the electromagnets to the total period of applied voltage. At a low duty ratio, the magnet valve is only closed briefly. The opening cross section averaged over time drops with the duty ratio.

It will be understood that each of the elements described above, or two or more together, may also find a useful application in other types of constructions differing from the types described above.

While the invention has been illustrated and described as embodied in a hydraulic control device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hydraulic control device for rotating a cam shaft of an internal combustion engine, comprising a hollow-cylindrical sprocket wheel driven by an internal combustion engine and having a central bore hole with a set of gear teeth at its inner circumference; a coupling member longitudinally displaceable by a hydraulic pressure and having a first location on an outer circumference of the coupling member provided with a first set of gear teeth engageable with a set of gear teeth located at an inner circumference of said cam shaft, and a second location provided on the outer circumference of the coupling member having a second set of gear teeth engaging with said set of gear teeth at the inner circumference of said central bore hole of said sprocket wheel, so as to form two gear teeth pairs, one of said gear teeth pairs constituting spiral gear teeth and the other of said gear teeth pairs constituting spur gear teeth; an electromagnetic valve arranged so that said coupling member is axially displaced by said hydraulic pressure controlled by said electromagnetic valve so as to bring about a relative rotation of said cam shaft relative to said sprocket wheel; a main piston acting on said coupling member and arranged so that said hydraulic pressure acts on said main piston; a main housing mounted on said drive wheel to which said cam shaft is also connectable; an axial piston pump connected to said main housing having axial bore holes being substantially parallel to a central axis of said cam shaft, and a plurality of additional pistons which are located in said axial bore holes; each piston having an outer rounded portion which contacts a wobble plate; outlet valves arranged at an outlet side of said bore holes and connected to a pressure space in the pump housing adjacent said main piston, said electromagnetic valve controls the hydraulic pump by controlling a pressure in said pressure space, said main piston and said coupling member arranged so that a mechanical force providing means acts on said coupling member against a force on said main piston.

2. A hydraulic control device as defined in claim 1, and further comprising pump housings which are formed in axial bore holes of said main housing and extend concentrically to a longitudinal axis of said main housing, said bore holes receiving said additional pistons sliding in said pump housings.

3. A hydraulic control device as defined in claim 2, wherein said wobble plate has recesses, said pump housings having web-like prolongations dipping into said recesses of said wobble plate.

4. A hydraulic control device as defined in claim 1, and further comprising an intermediate part located between the cam shaft and said sprocket wheel and having a continuation insertable into a longitudinal bore hole of the cam shaft, said spur gear teeth being formed at an inner circumference of said continuation.

5. A hydraulic control device as defined in claim 4, and further comprising a widened flange-like end part provided on the cam shaft, said intermediate part adjoining said end part, said sprocket wheel and said hydraulic body being located coaxially relative to said intermediate part; and further comprising a means for connecting said intermediate part, said sprocket wheel and said hydraulic body with one another.

6. A hydraulic control device as defined in claim 5, wherein said connecting means are formed as screws.

7. A hydraulic control device as defined in claim 1 wherein said electromagnetic valve is arranged coaxially relative to said main housing and is located partially in said main housing.

8. A hydraulic control device as defined in claim 1, wherein said main housing includes a first housing which directly adjoins said sprocket wheel and at least one pump housing connected to said first housing with said first housing and including a screw extending through a part of the cam shaft, said sprocket wheel and said first housing; and a spring disk type outlet valve arranged between said pump housing and said first housing and having a tongue-like valve part with an enlargement located at an outlet.

9. A hydraulic control device as defined in claim 1, wherein said electromagnetic valve has an armature and a coil body which receives the armature and has a longitudinal groove.

10. A hydraulic control device as defined in claim 1, wherein said mechanical force providing means is formed as a spring.

11. A hydraulic control device as defined in claim 1, wherein said spiral gear teeth have a pitch angle substantially between 30° and 45°.

* * * * *